US006517408B1

(12) United States Patent
Rehkemper et al.

(10) Patent No.: US 6,517,408 B1
(45) Date of Patent: Feb. 11, 2003

(54) FLYWHEEL POWERED BICYCLE WITH AN ARTICULATED RIDER

(75) Inventors: Jeffrey Rehkemper, Chicago, IL (US); David Combs, Romeoville, IL (US)

(73) Assignee: Rehco, LLC, Chicago, IL (US)

( * ) Notice: Subject to any disclaimer, the term of this patent is extended or adjusted under 35 U.S.C. 154(b) by 102 days.

(21) Appl. No.: 09/745,197

(22) Filed: Dec. 22, 2000

(51) Int. Cl.[7] ..... A63H 29/02; A63H 29/22

(52) U.S. Cl. ..... 446/462; 446/457; 446/440; 446/465

(58) Field of Search ..... 446/435, 440, 446/429, 441, 448, 457, 462, 465, 233, 275, 280, 279, 286, 288

(56) References Cited

U.S. PATENT DOCUMENTS

| | | | | |
|---|---|---|---|---|
| 639,567 A | | 12/1899 | Henderson | |
| 2,829,467 A | | 4/1958 | Pagano | |
| 3,886,682 A | * | 6/1975 | Ieda et al. | 446/429 |
| 4,201,011 A | * | 5/1980 | Cook | 446/440 |
| 4,526,554 A | * | 7/1985 | Goldfarb et al. | 446/429 |
| 5,643,036 A | * | 7/1997 | Liu et al. | 446/23 |
| 6,095,891 A | * | 8/2000 | Hoeting et al. | 446/431 |

FOREIGN PATENT DOCUMENTS

| | | | | |
|---|---|---|---|---|
| GB | 2130495 A | * | 6/1984 | A63H/17/00 |

* cited by examiner

*Primary Examiner*—Jacob K. Ackun
*Assistant Examiner*—Bena B. Miller

(57) ABSTRACT

In accordance with the present invention there is disclosed a toy bicycle that includes a rear wheel assembly rotatably connected to the bicycle. The rear wheel assembly encloses a flywheel and a means of interconnecting the flywheel and the rear wheel. The interconnecting means serves to energize the flywheel in response to a rotational force applied to the rear wheel and when the rotational force is removed the interconnecting means will continue to rotate the rear wheel in response to the inertia of the energized flywheel. An articulated rider, mounted to the seat of the bicycle, includes hands rotatably attached to handlebars and feet attached to pedals of the bicycle. When the bicycle is in motion, the articulated rider appears to pedal and operate the bicycle. The bicycle also includes a charger that engages and rotates the rear wheel of the bicycle and as such, energizes the flywheel.

18 Claims, 8 Drawing Sheets

FLYWHEEL POWERED BICYCLE WITH AN ARTICULATED RIDER

FIELD OF THE INVENTION

This invention relates to a flywheel powered bicycle with an articulated rider, of which the flywheel may be energized with an external charger, and of which the articulated rider appears to be operating the bicycle when the bicycle is in motion.

BACKGROUND OF THE INVENTION

Flywheels and inertia wheels utilized in toy vehicles are well known. For example: U.S. Pat. No. 4,201,011 to Cook discloses a flywheel toy motorcycle that includes the flywheel about the front end of the frame. The motorcycle also includes a cord that when pulled energizes the flywheel, which will rotate independently of the rear wheel. The motorcycle further includes a clutch that places the flywheel in engagement with a gear train that rotatably attaches to the rear wheel, such that when the flywheel is rotating and the clutch is moved to such a position, the flywheel engages the gear train and rotates the rear wheel.

In addition, U.S. Pat. No. 3,886,682 to Iede discloses a flywheel-powered toy motorcycle, which mounts the flywheel within the front portion of the frame. The flywheel is meshed through a series of gears to an end gear rotatably attached to the rear wheel and an external launcher may be meshed with the end gear to energize the flywheel.

Flywheel-powered toy vehicles, which include two, three or four wheeled vehicles, are well known and generally include a gear train that is designed to charge the flywheel to a RPM significantly faster than the vehicle initially, such that when the vehicle is released the inertia of the flywheel will propel the vehicle quickly and for a significant distance. Normally the flywheel and gear train are housed within the chassis of the vehicle, thereby preventing damage to an exposed flywheel or injury to the user. Since the flywheel and gear train are placed in a housing, the manufacturer will design or mold a housing that represents a vehicle or toy that the user can visually relate to, for instance, a car or motorcycle. In such toys, the manufacturer can easily house the flywheel and gear train in the chassis of the car or in the center of the motorcycle frame.

A bicycle, however, has an open frame that does not provide any enclosure that may house the flywheel. In order to accommodate the flywheel and gear train, the bicycle must position or place the same about one of the wheels; otherwise the appearance of the open frame of the vehicle would be lost. The ability to place the flywheel and gear train about the front wheel is well known, U.S. Pat. No. 2,829,467 to Pagano discloses a toy motorcycle that includes a flywheel rigidly secured on a shaft, and housed within a hollow front wheel, which is mounted on the shaft for independent rotation relative to the shaft and the flywheel. A cord wrapped around the end of the shaft and rapidly pulled off, spins the flywheel within the front wheel. When the motorcycle is placed on a flat surface, friction between the wheel hub and the front axle causes the wheel to propel the motorcycle. Since the flywheel may rotate faster than the front wheel, the flywheel also acts as a gyro for stabilization.

In toys powered by a flywheel, especially two wheel toy vehicles, the flywheel is used to balance the two-wheeled vehicle. While the vehicle is in motion, any number of things can upset the vehicle's stability causing the same to lean and fall to one side, for example, while moving over a flat surface, any imperfections in the surface could upset the balance and stability. In order to compensate for this the vehicle can be provided with caster steering. However, when the flywheel is enclosed within the front wheel, caster steering is removed in order to accommodate for the flywheel and gear train. As such it would therefore be desirable to place the flywheel in the rear wheel.

While full size bicycles have been provided in the past with a flywheel in the rear wheel of the bicycle, for instance U.S. Pat. No. 639,567, the person operating the bicycle powers the flywheel by pedaling the bicycle. More importantly, the person provides the needed stability and balance to keep the full size bicycle upright. In U.S. Pat. No. 639,567 the flywheel is only used to assist the power provided by the operator to help coast the bicycle and cannot aid in balancing or stabilizing the bicycle upright.

Generally, when a flywheel spins it creates a gyro effect on the bicycle itself, acting thereon to balance the bicycle. This effect is proportional to the difference in weight between the flywheel and the bicycle, such that when the weight of the flywheel is larger than the weight of the bicycle, the gyro effect will be greater. To the same extent, a real bicycle would include the weight of the person and bicycle, which would significantly outweigh the flywheel, unless the flywheel was extremely large or heavy, which is impractical. In toys the material used to manufacture the bicycle and rider, such as foam or plastics, can have a total weight much lighter than the weight of the flywheel and still visually appear proportional to each other. As such, a toy bicycle can have a small flywheel that produces a gyro effect on a light weight bicycle that aids in the stability and balance of the bicycle.

SUMMARY OF THE INVENTION

In accordance with the present invention there is disclosed a toy bicycle that includes a rear wheel assembly rotatably connected to the frame of the toy bicycle. The rear wheel assembly has a two-piece rear wheel that encloses a flywheel and a means of interconnecting the flywheel to the rear wheel housing such that the flywheel may rotate independently about the same axis as the rear wheel. Moreover, the interconnecting means provides the ability to energize the flywheel in response to an external rotational force applied to the rear wheel and when the external rotational force is removed the interconnecting means will continue to rotate the rear wheel in response to the inertia of the energized flywheel. The toy bicycle further includes a rear pulley simulating a sprocket (referred to herein as a "rear sprocket") that is secured to the rear wheel such that when the rear wheel rotates, the rear sprocket also rotates. The rear sprocket is further attached to a pedal/crank/sprocket assembly that is horizontally and rotatably mounted to the frame, such that the rotation of the rear sprocket further rotates the pedal/crank/sprocket assembly. An articulated rider, mounted to the seat of the bicycle, has hands attached to the handlebars and has feet attached to pedals defined by the pedal/crank/sprocket assembly. When the pedal/crank/sprocket assembly rotates, the articulated rider having joints positioned in the legs appears to pedal the pedal/crank/sprocket assembly and as such the articulated rider appears to be operating the bicycle.

In one embodiment, the bicycle further includes the means to energize the flywheel through an external charger. The external charger is motorized such that the user can hold on to the bicycle and energize the flywheel effortlessly. After the flywheel is energized, the user can easily remove the external charger, place the bicycle on a surface and watch it drive away. In yet another embodiment the flywheel may be energized in an external launcher that includes a mechanical charger. The user places the bicycle in the launcher and begins to mechanically charge the flywheel by rotating the rear wheel. When flywheel is sufficiently energized, the user stops mechanically rotating the rear wheel. However, the energized flywheel will continue to rotate the rear wheel such that the bicycle automatically propels itself out of the launcher.

Numerous other advantages and features of the invention will become readily apparent from the following detailed description of the invention and the embodiments thereof, from the claims, and from the accompanying drawings.

BRIEF DESCRIPTION OF THE DRAWING

A fuller understanding of the foregoing may be had by reference to the accompanying drawings, wherein.

DETAILED DESCRIPTION OF THE INVENTION

Figure 1:
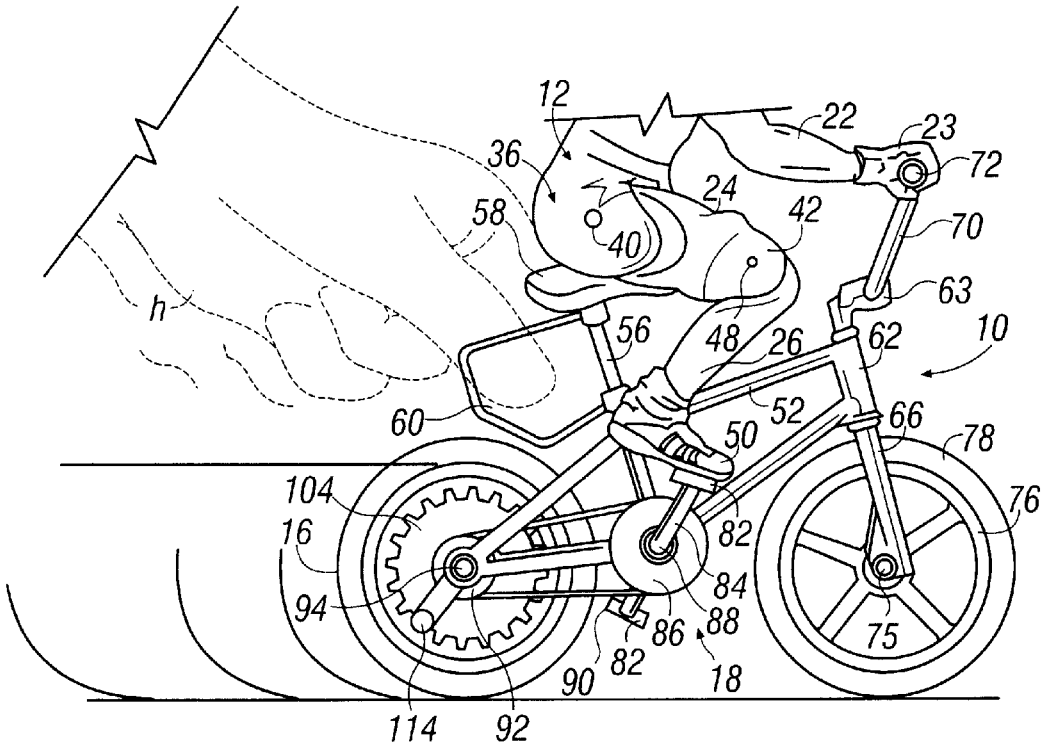
FIG. 1 is a side view of the toy bicycle and a partial view of an articulated figure, both of which are illustrated in accordance with the present invention.

While the invention is susceptible to embodiments in many different forms there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Illustrated in FIG. 1 and in accordance with the present invention, a flywheel bicycle 10 is provided that includes an articulated rider 12, which when the bicycle is in motion, visually appears to be pedaling the bicycle 10 and thus appears to be operating the bicycle. A flywheel (not shown) is included in the rear wheel 16 of the bicycle 10, which may be energized by a user h holding on to the bicycle 10 and continually pushing or rotating the rear wheel forward, or exerting an external rotational force upon the rear wheel 16. Once the flywheel is sufficiently energized the user may stop rotating the rear wheel 16 and release the bicycle 10. The inertia of the flywheel will thereafter cause the rear wheel 16 to continue to rotate, powering and balancing the bicycle 10 forward.

In addition, a pedal/crank/sprocket assembly 18, discussed in further detail below, is attached by a belt 90 to the rear wheel 16 such that the rotation of the rear wheel 16 also rotates the assembly 18. The articulated rider 12 includes hands 23 that are rotatably attached to a handlebar assembly 70 and includes feet 50 that are separately attached to the pedal/crank/sprocket assembly 18. When the bicycle is in motion, the pedal/crank/sprocket assembly 18 rotates, moving the legs of the articulated rider 12 and providing the visual appearance that the rider 12 is pedaling and powering the bicycle 10.

As illustrated, the flywheel is positioned or housed in the rear wheel 16 providing the ability to maintain the visual representation of a bicycle. In addition the front end 62 of the bicycle includes a caster steering 63, which aids the flywheel in balancing the bicycle upright, because if the bicycle 10 were to begin to lean to one side the caster steering 63 would cause the bicycle 10 to turn opposite of the direction of the lean leveling the bicycle 10.

Moreover, if the flywheel was positioned in the front wheel it would be difficult to utilize the flywheel to rotate a pedal/crank/sprocket assembly, without attaching the pedal/crank/sprocket assembly to the front wheel. Since real bicycles attach the pedal/crank/sprocket assembly to the rear wheel, if in the instant invention the pedal/crank/sprocket assembly was attached to the front wheel, the invention would no longer accurately and visually represent a bicycle.

Figure 2:
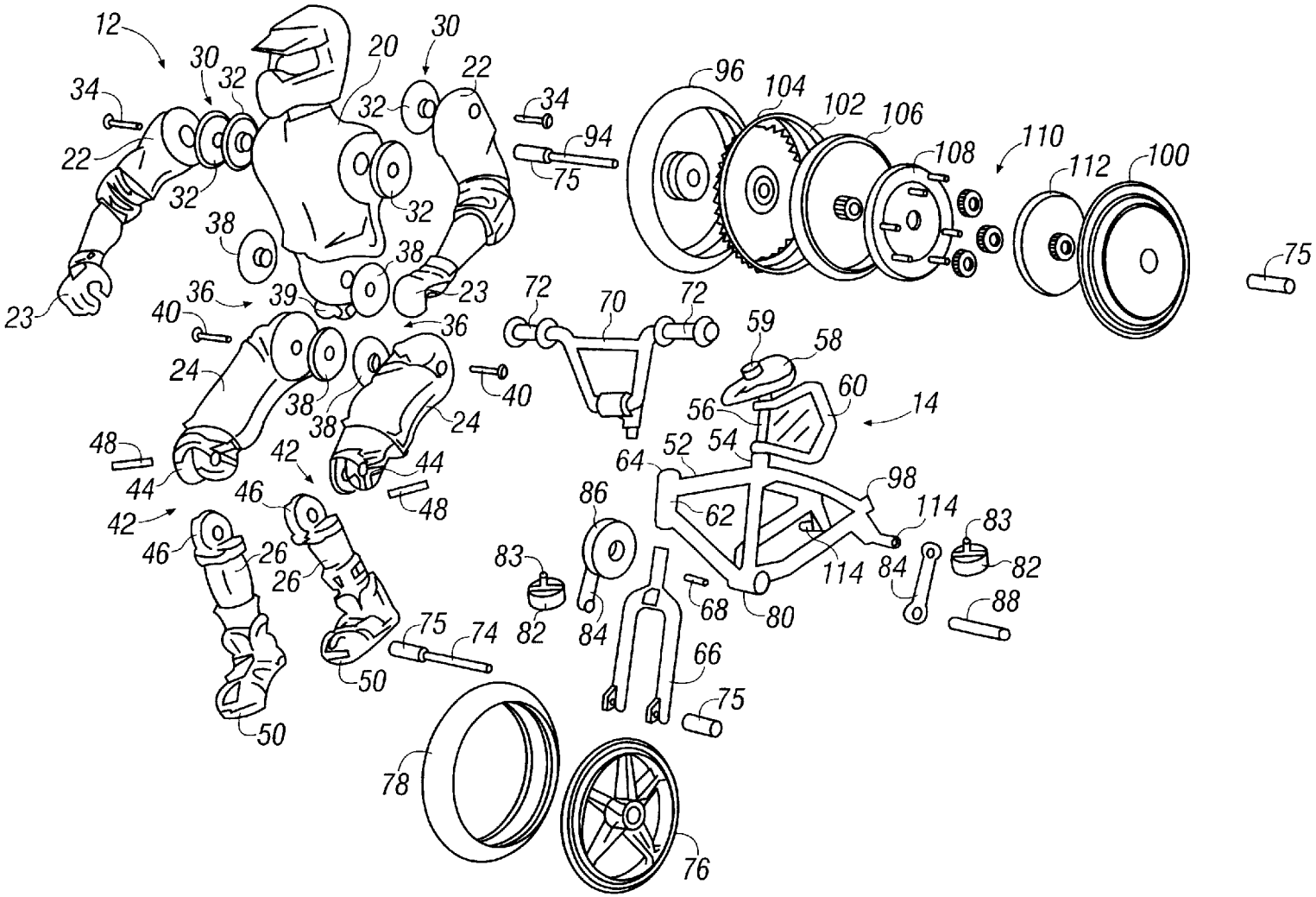
FIG. 2 is an exploded view of the bicycle and articulated figure in accordance with the present invention.

Further reference is now drawn to FIG. 2, which is an exploded view of the flywheel bicycle 10 with the articulated rider 12. The articulated rider 12 includes a torso 20 jointed to two arms 22 and to two upper leg portions 24, wherein each upper leg portion 24 is further jointed to a lower leg portion 26. The arms 22 are jointed to the torso 20 at a shoulder joint 30, which permits the arms to pivot about a shoulder joint pin 34. The shoulder joint 30 includes a pair of joint plates 32 that individually secure into the arm 22 and the torso 20, and the shoulder joint pin 34 positioned there through further prevents the arm 22 from separating from the torso 20. The upper leg portions 24 are jointed to the torso at a hip joint 36, which permits the upper leg portion to pivot about a hip joint pin 40. Each hip joint 36 includes a pair of joint plates 38 that are individually secured into the upper leg portion 24 and the torso 20, with the hip joint pin 40 positioned there through further preventing the upper leg portion 24 from separating from the torso 20. The upper leg portions 24 are also jointed to lower leg portions 24 by a knee joint 42, which permits the lower leg portions 24 to pivot about a knee pin 48. A clevis end 44 on the upper leg portion 24 that is sized to receive an end 46 of the lower leg portion 26 defines each knee joint 42. The upper leg portion 24 and lower leg portion 26 are pivotally secured together by the pin 48 positioned through the clevis end 44 and the end 46 on the lower leg portion 26. The lower leg portions 26 further include feet 50, which as described in further detail below attach to pedals 82 on the bicycle 14.

The bicycle 10 has a frame assembly that permits the attachment of a seat assembly, a handlebar assembly, a pedal/crank/sprocket assembly and a front and rear wheel assembly. More specifically, the bicycle 10 includes a frame 52 that includes a tubular portion 54, which is designed to receive one end of a seat post 56. The other end of the seat post 56 securely receives a seat 58, which includes a projection 59 that is securely received in a slot 39 on the lower portion of the torso 20, thereby securing the articulated rider 12 to the seat 58. The seat post 56 further receives a plate 60 that the user h may grab in order to energize the bicycle 10, shown in FIG. 1. The front end 62 of the bike 10 includes a tubular post 64 that secures a front fork 66 by a steering pin 68. A handlebar assembly 70, which includes handgrips 72, attaches to the top portion of the front fork 66 through the tubular post 64. When assembled, the hands 23 of the rider 12 rotatably attach to the handgrips 72, providing the visual appearance that the rider 12 is steering the bicycle. Moreover, since the hands 23 may rotate, the rider 12 may be positioned in various stunt positions, such as placing the feet 50 on the seat 58. Connected to the front fork 66 via its lower end by a front axle 74 is a front wheel 76 on which is located a tire 78. In addition, a pair of foot pegs 75 may be attached to the front axle 74 and the rear axle 94. The feet 50 of the articulated rider 12 may be moved to rest on the foot pegs 75, thereby providing the articulated rider 12 with a coasting, resting or stunt position.

Secured to a horizontally disposed tubular support 80 at the midsection of the frame 52 is the pedal/crank/sprocket assembly 18 that will rotate along with the rear wheel 16. The pedal/crank/sprocket assembly 18 includes pedals 82, each of which include a peg 83 that engage the underside of each foot 50, thereby securing each foot to a pedal 82. Each pedal 82 is rotatably connected to a crank 84 that further attaches to a front sprocket 86 about a crank axle 88 that extends through the horizontal tubular support 80. The front sprocket 86 is connected through a belt 90 (shown in FIG. 1) to a rear sprocket 92, which is located about the rear axle 94 and described in greater detail below. In addition, attached to the rear end 98 of the frame 52 are a pair of launch pegs 114 that extend outwardly and substantially perpendicular from the frame 52 and are also described in greater detail below in reference to a launcher.

The rear wheel assembly includes a rear tire 96 disposed about the rear wheel 16, which is rotatably attached to the rear end 98 of the frame 52 about the rear axle 94. The rear wheel 16 is defined by a left and right flywheel housing 100 and 102 and includes an exterior launch gear 104, which permits the bicycle 10 to be energized and launched by a separate launcher mechanism, discussed in greater detail below. The rear wheel assembly also has a power mechanism connected to the rear wheel 16 and mounted on said axle such that the power storage mechanism may store inertia energy in response to the rotation of the rear wheel 16 and may rotate the rear wheel 16 in response to the stored inertia energy. The power storage mechanism is housed within the flywheel housing 100 and 102 and is defined by a flywheel 106 and a means for interconnecting the flywheel 106 to the rear wheel 16. The flywheel 106 is mounted for independent rotation about the same axis as the rear wheel 16. The means for interconnecting the flywheel 106 to the rear wheel 16 is also enclosed within the flywheel 106 housings 100 and 102. The interconnecting means serves to energize the flywheel 106 in response to an external rotational force applied to the rear wheel 16 and when the external rotational force is removed the interconnecting means continues to rotate the rear wheel 16 in response to the inertia of the energized flywheel 106. The interconnecting means is defined by the flywheel being independently mounted to the right flywheel housing 102 and meshed to a gear plate 108 that is further meshed to an internal gear 112 through a series of gears 110. The internal gear 112 is attached to the left flywheel housing 100.

The rear sprocket 91 is secured to the right flywheel housing 102 and rotates the front sprocket 86, via the belt 90, when the rear wheel 16 is rotating. The rotation of the front sprocket 86, as mentioned above, turns the cranks 84 and the pedals 82, causing the articulated rider 12 to appear as if it was pedaling and operating the bicycle 10.

In operation the external rotation of the rear wheel 16, causes the internal gear 112 to rotate or energize the flywheel 106. Once the external rotation stops, the energized flywheel 106 continues to rotate the internal gear 112, which will rotate the rear wheel 16, as long as the inertia of the energized flywheel 106 continues to power the internal gear 112. By mounting the flywheel 106 independently about the same axis as the rear wheel 16 and meshing the flywheel 106 to the interconnecting means within the rear wheel 16, the flywheel 106, when spinning causes a gyroscopic effect that helps keep the bicycle 10 vertical.

Figure 4:
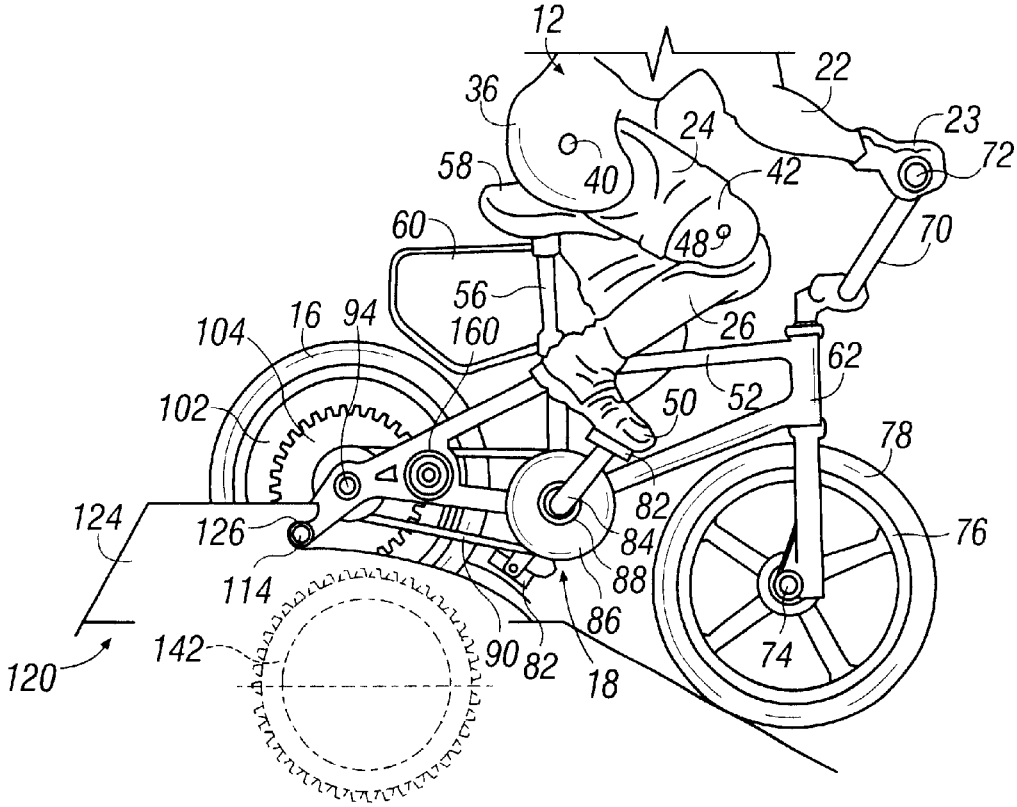
FIG. 4 is a side view showing the bicycle positioned in the launcher, such that the launcher pegs of the bicycle are positioned in the notches of the support walls of the launcher.
Figure 5:
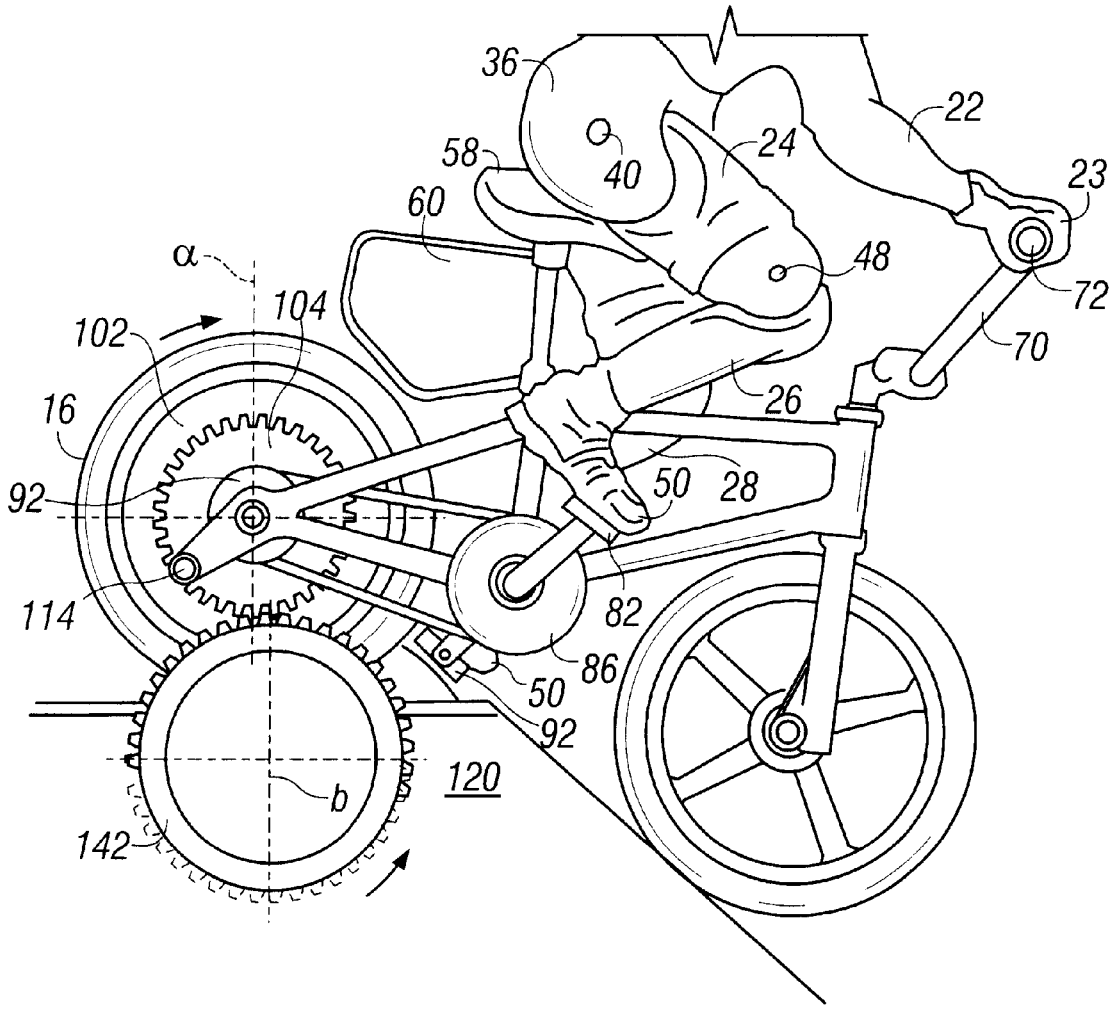
FIG. 5 is another side view of FIG. 4 showing the engagement of the rear wheel and the drive gear and further illustrating the rear wheel centerline being aft of the drive gear centerline, which acts to retain the bicycle in the launcher.
Figure 6:
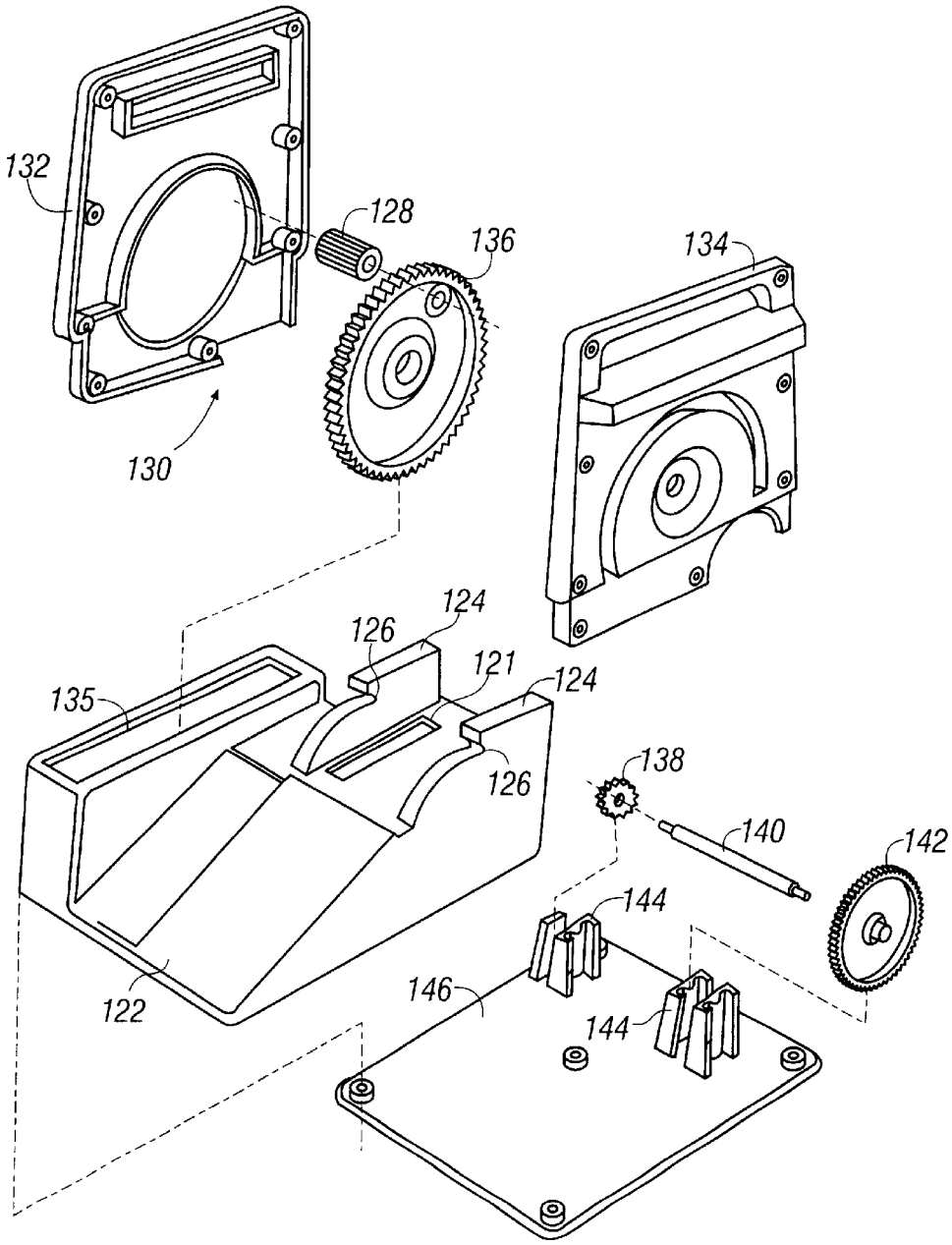
FIG. 6 is an exploded view of the launcher.

As described briefly above, the flywheel 106 of the bicycle 10 may be mechanically charged and launched from an external launcher, such as the one illustrated in FIGS. 3–6. As illustrated in FIG. 6, the launcher 120 includes a drive gear 142 that partially protrudes from an aperture 121 on the topside of the ramp 122. The drive gear 142 is secured to a crank gear 138 on a launch axle 140. Both the drive gear 142 and the crank gear 138 rotatably rest in supports 144 that extend upwardly from the base 146 of the launcher 120. The drive gear 142 is meshed to a crank wheel 136 that is rotatably housed within two halves 132, 134 of a crank wheel housing 130. The crank wheel housing 130 is secured to the ramp 122 through an opening 135 on the side of the launcher 120. A crank handle 128 may be used to rotate the crank wheel 136, which further rotates the drive gear 142. The launcher 120 also includes a pair of guide walls 124 each of which includes a notch 126.

Figure 3B:
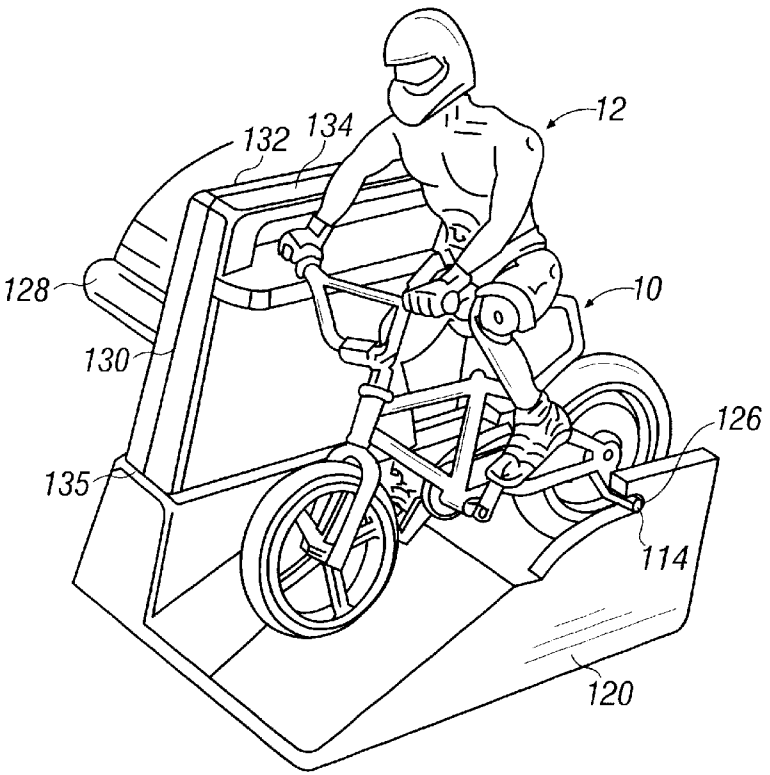
FIG. 3*b* is another perspective illustration of FIG. 3*a* showing the rear wheel of the toy bicycle being engaged and rotated by the launcher.
Figure 3A:
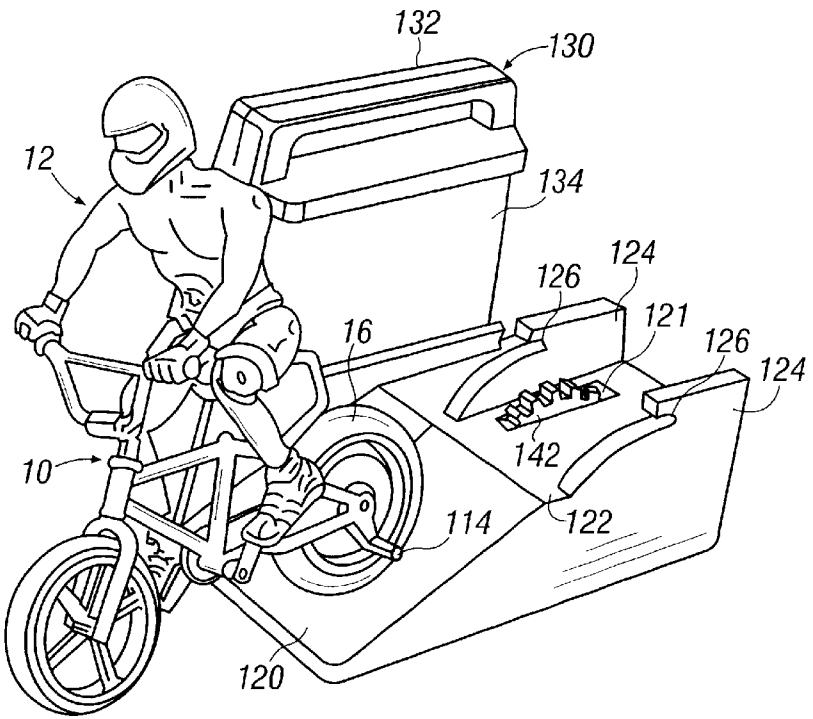
FIG. 3*a* is a perspective view of the toy bicycle and articulated figure from FIG. 2 and a launcher, illustrating the bicycle and articulated figure being positioned into the launcher.

In FIG. 3*a* the bicycle 10 is shown entering the launcher 120, while in FIG. 3*b* the bicycle 10 is positioned between the guide walls 124. The launcher pegs 114 that extend outwardly from the rear end 98 of the frame 52 are positioned such that they may engage the notches 126. When the bicycle 10 is in position as illustrated in 3*b*, the drive gear 142 engages the launch gear 104. The crank handle 128 may be used to rotate the drive gear 142 and thus energize the flywheel 106.

Illustrated in FIGS. 4 and 5, the bicycle 10 is shown in the launcher 120. When the launcher pegs 114 are positioned in the notches 126, the centerline of the rear wheel 16 aligns slightly aft of the centerline and of the drive gear 142. As the drive gear 142 rotates, the rear wheel 16 begins to rotate thus energizing the flywheel 106. While the inertia of the drive gear 142 is greater than the rotation of the rear wheel 16 the bicycle 10 will have a tendency to move backwards because the centerline of the rear wheel 16 is aft of the centerline and of the drive gear 142, as such the bicycle remains in the launcher. However, as soon as the user stops or slows down the rotations of the drive gear 142, the inertia of the energized flywheel 106 begins to rotate the real wheel 16 faster than the inertia of the drive gear 142, causing the bicycle to automatically launch out of the launcher 120.

Figure 8:
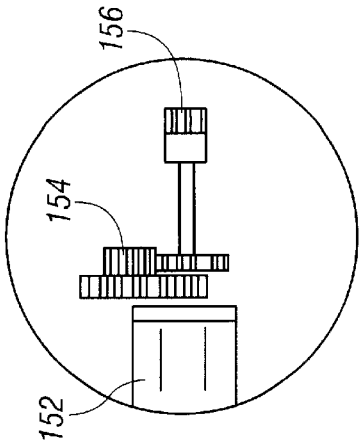
FIG. 8 is a side view of the motor assembly contained within the motorized external charger.
Figure 7:
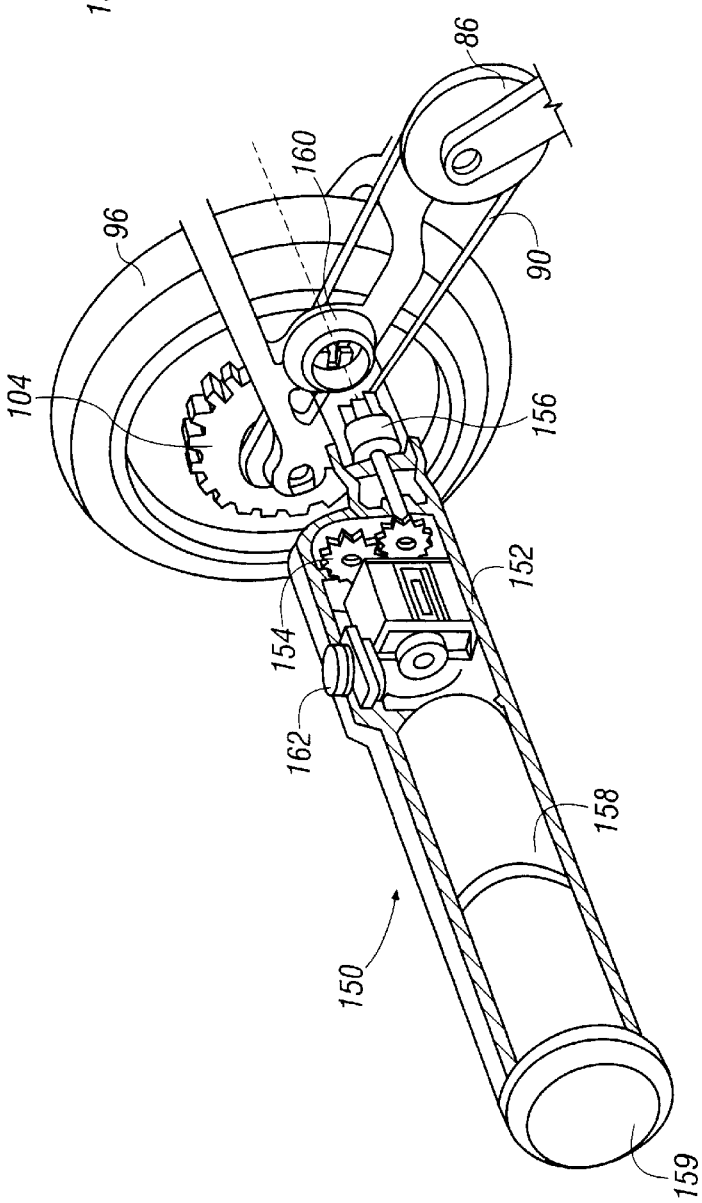
FIG. 7 is a perspective illustration showing a cut away view of a motorized external charger with a rear wheel assembly of the bicycle having a socket to receive the motorized external charger.
Figure 9:
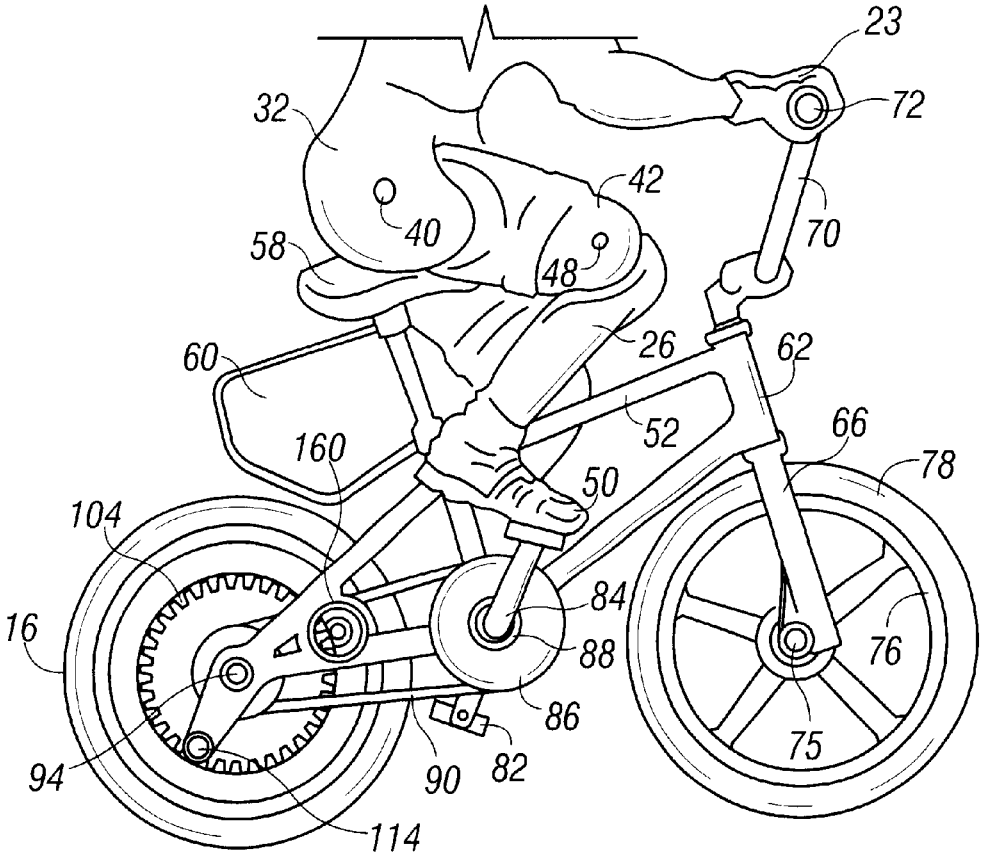
FIG. 9 is a side view of the bicycle having a socket to receive the motorized external charger.

In addition a motorized external charger 150 may also be used to energize the flywheel 106, illustrated in FIGS. 7 through 9. The motorized external charger 150 houses a motor 152 that operatively controls a pinion gear 156 through a gear train 154. The motor is powered by a pair of batteries 158 which may be removed from the bottom portion 159 of the motorized external launcher 150. The pinion gear 156 passes through a socket 160 such that the pinion gear 156 may engage the launch gear 104 such that when the motorized external charger 150 rotates the pinion gear 156 the launch gear 104 rotates, energizing the flywheel 106. The socket 160 acts to keep the pinion gear in engagement while the flywheel 106 is energizing. The user holding the bicycle 10 and the motorized external charger 150 places the pinion gear 156 into the socket 160 and then presses a switch 162 which turns the motor 152 on and off. Since the motorized external charger 150 is small and compact, the user is able to carry it around with them easily.

As described above, rotating the rear wheel 16 against a flat surface may also energize the flywheel 23. As such the launcher/charger may be removed and the launch gear 104 and the launcher pegs 114 may be removed from the bicycle 10 without diverting from the scope of the present invention.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A toy bicycle including a frame assembly, seat assembly, handlebar assembly, and a front wheel assembly connected to said frame assembly, and further including:

a rear wheel assembly defined by a rear wheel mounted on a rear axle that is rotatably connected to the frame assembly, the rear wheel assembly also has a power storage mechanism connected to the rear wheel and mounted on said axle such that the power storage mechanism may store inertia energy in response to the rotation of the rear wheel and may rotate the rear wheel in response to the stored inertia energy, wherein the power storage mechanism includes a flywheel mounted on said axle for independent rotation in relation to the rear wheel, and a means for interconnecting the flywheel to the rear wheel, wherein the interconnecting means may energize the flywheel in response to an external rotation force applied to the rear wheel and wherein the interconnecting means may rotate the rear wheel in response to inertia energy of the energized flywheel;

a pedal/crank/sprocket assembly horizontally and rotatably mounted to the frame assembly;

a rear sprocket secured to the rear wheel, such that the rotation of the rear wheel rotates the rear sprocket; and a belt connecting the pedal/crank/sprocket assembly to the rear sprocket such that the rotation of the rear sprocket rotates said pedal/crank/sprocket assembly.

2. The toy bicycle of claim 1 wherein the rear wheel is defined as two halves, the two halves housing the flywheel and the interconnecting means.

3. The toy bicycle of claim 2 further including a plate attached to the seat assembly such that a user may grip the plate to firmly hold the bicycle while externally rotating the rear wheel to energize the flywheel.

4. The toy bicycle of claim 1 further comprising:

an articulated rider mounted to the seat assembly and having hands rotatably attached to the handlebar assembly and feet attached to pedals defined by the pedal/crank/sprocket assembly, such that when the pedal/crank/sprocket assembly rotates, the articulated rider having articulated legs appears to pedal the pedal/crank/sprocket assembly.

5. The toy bicycle of claim 4 further comprising:

a charger having a means to engage the rear wheel of said bicycle and a means to rotate the engaging means so as to rotate and energize the flywheel.

6. The toy bicycle of claim 5 wherein the charger has an electric motor that rotates a pinion gear, the pinion gear is sized to engage the rear wheel of the toy bicycle such that when the pinion gear rotates the rear wheel rotates energizing the flywheel.

7. The toy bicycle of claim 5 wherein the charger is a mechanical charger that includes a launcher, the launcher having a means to retain the bicycle in the engaging means while inertia of the engaging means is greater than the inertia of the energized flywheel, wherein when the inertia of the energized flywheel is greater than the inertia of the engaging means, the rear wheel will self propel the bicycle out of the launcher.

8. The toy bicycle of claim 7 wherein the mechanical charger includes an engaging means defined by a drive gear and the rotating means defined by a crank that rotates said drive gear.

9. The toy bicycle of claim 8 wherein the retaining means include:

a pair of launcher pegs extending outwardly and substantially perpendicular from the frame assembly of the bicycle; and a pair of guide walls spaced apart to receive the rear wheel of the bicycle, each guide wall having a notch sized to receive the launcher pegs such that the rear wheel centerline is aft of the drive gear centerline.

10. A toy bicycle and charger in combination comprising:

a bicycle including a rear wheel mounted on a rear axle that is rotatably connected to said bicycle, a flywheel mounted on the rear axle and a means for interconnecting the flywheel to the rear wheel such that the flywheel may store inertia energy in response to the rotation of the rear wheel and the flywheel may rotate the rear wheel in response to the stored inertia energy; and a charger having a means to engage and rotate the rear wheel such that the flywheel energizes, wherein said bicycle includes a socket in communication with the rear wheel, and wherein the charger has an electric motor that rotates a pinion gear that slides into the socket and engages the rear wheel whereby when the electric motor is operating, the pinion gear rotates the rear wheel energizing the flywheel, and wherein said charger further includes a launcher that includes a means to receive said bicycle, said charger also including a drive gear positioned to engage the rear wheel when said bicycle is received in said launcher, and a means to mechanically rotate the drive gear such that when said bicycle is received in said launcher and the drive gear is rotated, the rear wheel rotates to energize the flywheel, wherein when the drive gear rotates slower than the rear wheel, the inertia of the energized flywheel continues to rotate the rear wheel faster than the drive wheel, such that the toy bicycle launches out of the launcher.

11. The combination of claim 10 wherein the receiving means includes a pair of launch pegs extending outwardly and substantially perpendicular from said bicycle, and a pair of slotted notches defined on said launcher and sized to receive the launch pegs such that a centerline of the rear wheel is aft of a centerline of the drive gear.

12. The combination of claim 11, wherein said bicycle further includes:

a pedal/crank/sprocket assembly rotatably secured to a horizontally disposed shaft defined by said bicycle;

a rear sprocket secured to the rear wheel, such that the rotation of the rear wheel rotates the rear sprocket; and a belt connecting the pedal/crank/sprocket assembly to the rear sprocket such that the rotation of the rear sprocket further rotates said assembly.

13. The combination of claim 12 further comprising:

an articulated rider mounted to a seat defined by said bicycle, the articulated rider having hands attached to a handlebar assembly mounted to said bicycle, and having feet attached to pedals defined by the pedal/crank/sprocket assembly, such that when the pedal/crank/sprocket assembly rotates, the articulated rider having articulated legs may appear to pedal the pedal/crank/sprocket assembly.

14. A toy bicycle including a frame assembly, seat assembly, handlebar assembly, a pedal/crank/sprocket assembly and a front wheel assembly connected to said frame assembly, and further including:

a rear wheel assembly defined by a rear wheel mounted on a rear axle that is rotatably connected to the frame assembly, the rear wheel having two halves enclosing a power storage mechanism connected to the rear wheel and mounted on the rear axle such that the power storage mechanism may store inertia energy in response to the rotation of the rear wheel and may rotate the rear wheel in response to the stored inertia energy;

a belt connecting the pedal/crank/sprocket assembly to a rear sprocket secured on the rear axle, wherein the rotation of the rear sprocket rotates said pedal/crank/sprocket assembly; and an articulated rider mounted to a seat defined by said seat assembly, the articulated rider having hands attached to the handlebar assembly, and having feet attached to pedals defined by the pedal/crank/sprocket assembly, such that when the pedal/crank/sprocket assembly rotates, the articulated rider having articulated legs appears to pedal and operate the pedal/crank/sprocket assembly.

15. The toy bicycle of claim 14 wherein the power storage mechanism includes:

a flywheel mounted on said axle for independent rotation in relation to the rear wheel; and a means for interconnecting the flywheel to the rear wheel, wherein the interconnecting means may energize the flywheel in response to an external rotation force applied to the rear wheel and wherein the interconnecting means may rotate the rear wheel in response to inertia energy of the energized flywheel.

16. The toy bicycle of claim 15 further comprising:

a launcher that includes a means to receive said bicycle, the launcher further including a mechanical charger, the mechanical charger defined by a drive gear positioned to engage the rear wheel when said bicycle is received in said launcher, and a means to mechanically rotate the drive gear such that when said bicycle is received in said launcher and the drive gear is mechanically rotated, the rear wheel rotates to energize the flywheel, wherein when the drive gear rotates slower than the rear wheel the inertia of the energized flywheel continues to rotate the rear wheel faster than the drive wheel, such that the toy bicycle launches out of the launcher.

17. The toy bicycle of claim 16 wherein the receiving means includes a pair of launch pegs extending outwardly and substantially perpendicular from said bicycle, and a pair of notches defined on said launcher and sized to receive the launch pegs such that a centerline of the rear wheel is aft of a centerline of the drive gear.

18. The toy bicycle of claim 15 further comprising:

a charger having a pinion gear that engages the rear wheel of said bicycle, the charger further having an electric motor that powers and rotates the pinion gear such that when operative the charger rotates the rear wheel and energizes the flywheel.

* * * * *